US009463559B1

(12) United States Patent
Chan

(10) Patent No.: US 9,463,559 B1
(45) Date of Patent: Oct. 11, 2016

(54) TOOL POSITIONING DEVICE

(71) Applicant: Fu-Yi Chan, Taichung (TW)

(72) Inventor: Fu-Yi Chan, Taichung (TW)

( * ) Notice: Subject to any disclaimer, the term of this patent is extended or adjusted under 35 U.S.C. 154(b) by 0 days.

(21) Appl. No.: 14/790,007

(22) Filed: Jul. 2, 2015

(51) Int. Cl.
*B25B 23/16* (2006.01)
*B25B 23/00* (2006.01)
*B25B 15/00* (2006.01)

(52) U.S. Cl.
CPC ..... *B25B 23/0035* (2013.01); *B25B 15/001* (2013.01); *B25B 23/0021* (2013.01)

(58) Field of Classification Search
CPC ..... B25B 23/0035; B25B 23/0021; B25B 15/001
USPC ..... 81/177.8–177.85
See application file for complete search history.

(56) References Cited

U.S. PATENT DOCUMENTS 1,864,466 A * 6/1932 Peterson ..... B25B 23/0035 279/2.12
4,768,405 A * 9/1988 Nickipuck ..... B25B 15/001 403/325
6,164,169 A * 12/2000 Goff ..... B25B 23/0035 403/325
6,343,903 B1 * 2/2002 Huang ..... B23B 29/046 279/2.23
6,901,827 B1 * 6/2005 Yen ..... B25B 15/001 81/177.5
7,387,053 B2 * 6/2008 Lee ..... B25B 23/0021 81/177.1
7,481,136 B2 * 1/2009 Chiang ..... B25B 13/102 81/177.75
7,669,860 B2 * 3/2010 Chiang ..... B23B 31/008 279/128
7,905,163 B1 * 3/2011 Chiang ..... B25B 15/001 81/177.7
8,505,418 B1 * 8/2013 Chiang ..... B25B 23/0035 81/124.2
8,651,764 B2 * 2/2014 Lin ..... B25B 23/0021 403/322.2

* cited by examiner

*Primary Examiner* — Hadi Shakeri
*Assistant Examiner* — Danny Hong

(57) ABSTRACT

A tool positioning device includes a rod, a movable member, a bead, a resilient member, a sleeve, a fixing ring and a rotary unit. The rod has a function end and a rectangular head respectively on two ends thereof. The rectangular head has a first recess, a second recess and a hole. The movable member is located in the first recess and has a cone-shaped section. The bead is located in the second recess. The connector extends through the hole and the through hole, and biased by the resilient member. The sleeve is mounted to the rod and has a shoulder. The connector contacts the shoulder. The connector moves within the first hole to move the movable member within the first recess by pulling the sleeve so that the cone-shaped section is backward and the bead is retracted into the second recess to release the tool attached to the rod.

9 Claims, 9 Drawing Sheets

B-B

B-B

B-B

B-B

TOOL POSITIONING DEVICE

BACKGROUND OF THE INVENTION

1. Fields of the Invention

The present invention relates to a positioning device, and more particularly, to a positioning device for quickly connecting a tool to and releasing a tool from an extension rod.

2. Descriptions of Related Art

The conventional tool positioning device is disclosed in U.S. Pat. No. 1,864,466 and includes a rod which has a connection portion protruding from the rod. The rod has a first recess and an elongate slot. A second recess is located beside the connection portion. A movable member located in the first recess and has a hole and a tapered end. A resilient member is located in the first recess and biases the movable member. An operation member is connected to the connection portion and has a third recess. A bead is located in the second and third recesses and contacts the movable member so as to connect the rod and the operation member. A collar is mounted to the rod. A pin extends through the elongate slot and the hole. However, the elongate slot in the rod is made by using a milling machine to cut the elongate slot along a straight line on the rod. This action is difficult and may increase the manufacturing cost.

The present invention intends to provide a tool positioning device to eliminate the shortcomings mentioned above.

SUMMARY OF THE INVENTION

The present invention relates to a tool positioning device and includes a rod, a movable member, a bead, a resilient member, a sleeve, a fixing ring and a rotary unit. The rod has a function end and a rectangular head respectively on two ends thereof. The rectangular head has a first recess, a second recess and a hole. The movable member is located in the first recess and has a cone-shaped section. The bead is located in the second recess. The connector extends through the hole and the through hole, and biased by the resilient member. The sleeve is mounted to the rod and has a shoulder. The connector contacts the shoulder. The connector moves within the first hole to move the movable member within the first recess by pulling the sleeve so that the cone-shaped section is backward and the bead is retracted into the second recess to release the tool attached to the rod.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figures 1, 2:
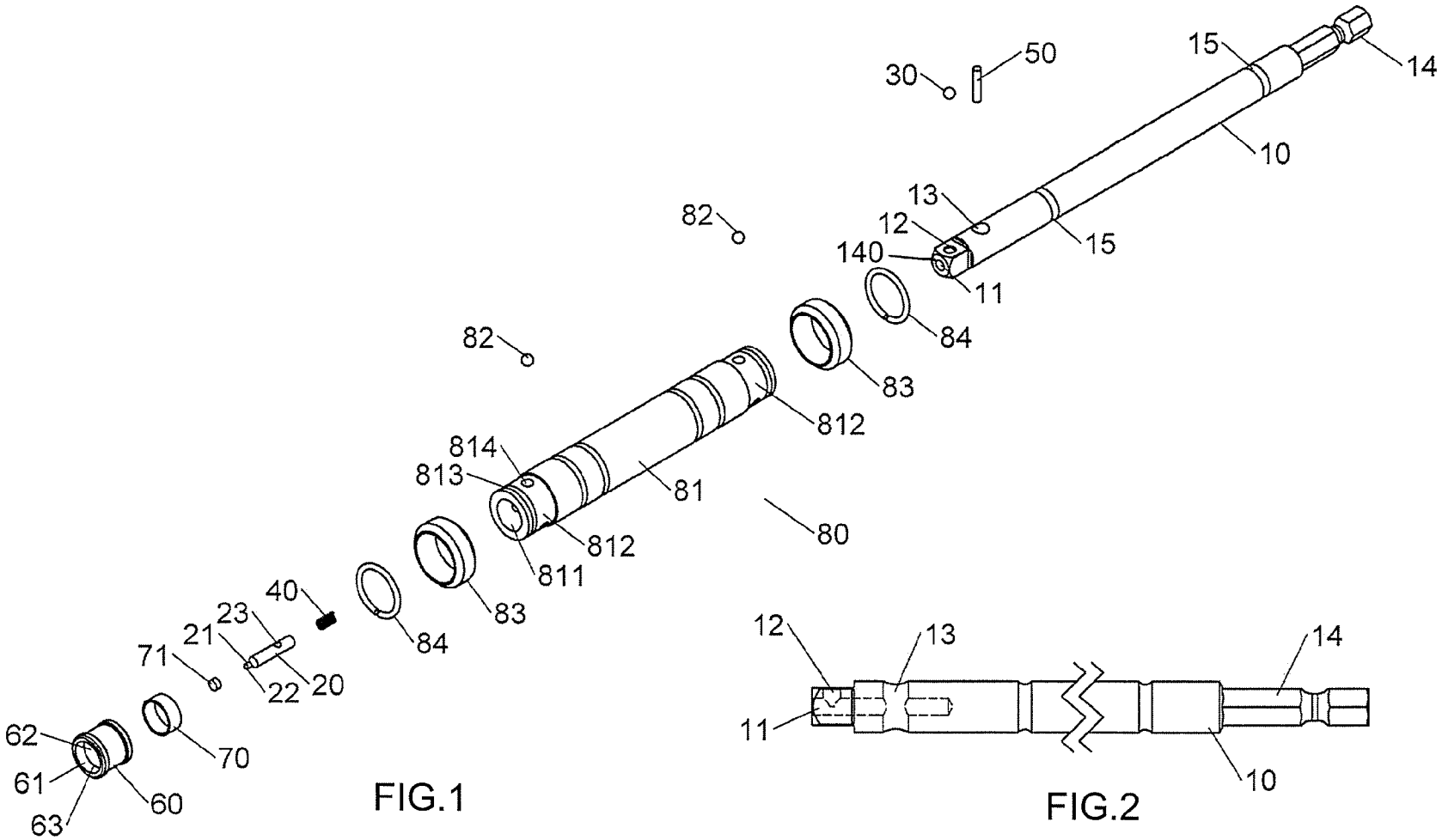
FIG. 1 is an exploded view of the tool positioning device of the present invention.
FIG. 2 is a side view of the tool positioning device of the present invention to show the first and second recesses.
Figure 3:
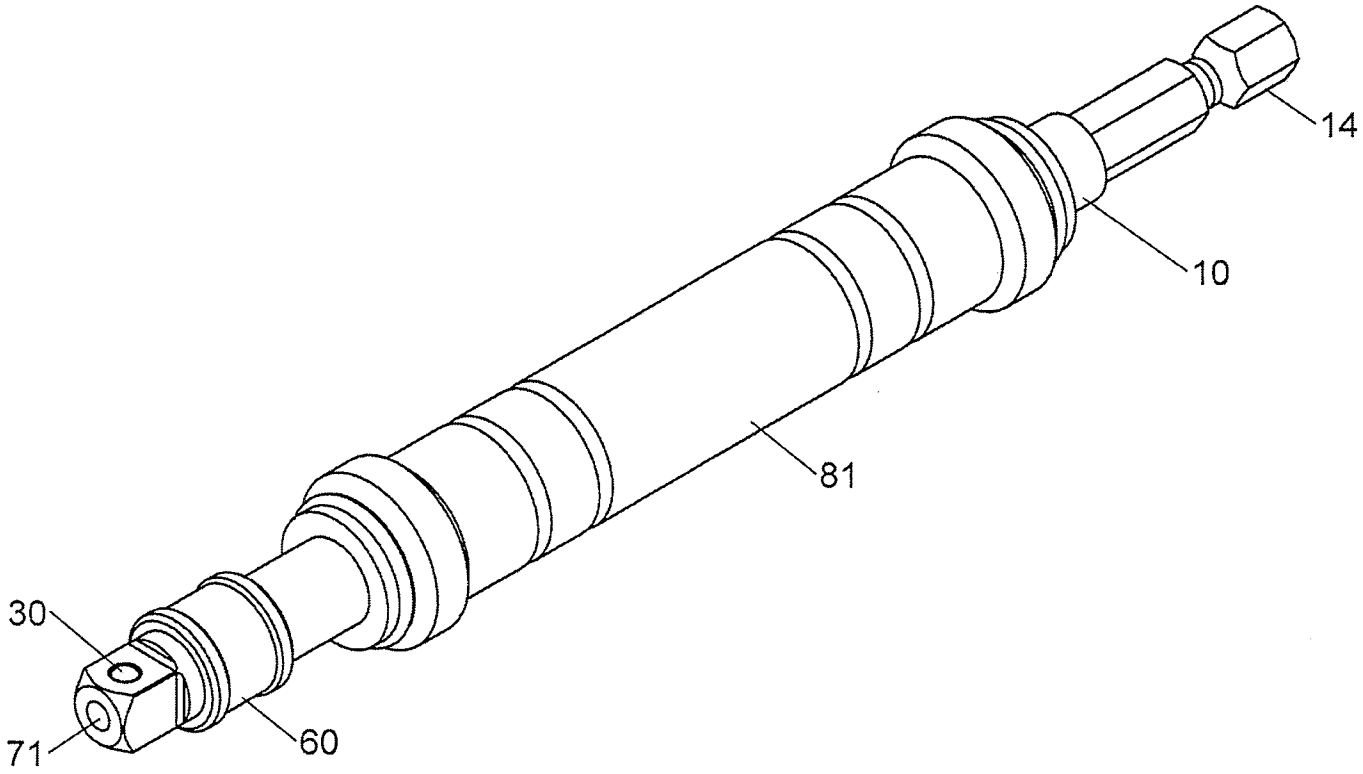
FIG. 3 is a perspective view to show the tool positioning device of the present invention.

Referring to FIGS. 1 to 3, the tool positioning device of the present invention comprises an elongate rod 10 which has a function end 14 and a rectangular head 140 respectively on two ends thereof. The rectangular head 140 has a first recess 11 and a second recess 12, wherein the first recess 11 defined axially in the rectangular head 140, and the second recess 12 is a circular recess and communicates with the first recess 11 perpendicularly. A first hole 13 is defined through the rod 10 and communicates with the first recess 11. The diameter of the first hole 13 is larger than the diameter of the first recess 11 and the diameter of the second recess 12. At least one first groove 15 is defined in the outside of the rod 10.

A movable member 20 is located in the first recess 11 and has a cylindrical section 21 extending from one end thereof. The cylindrical section 21 has a cone-shaped section 22 at its distal end thereof. The movable member 20 has a through hole 23 which is located to communicate with the first hole 13. The diameter of the through hole 23 is smaller than ½ of the diameter of the first hole 13.

A ball-shaped first bead 30 is located in the second recess 12 and contacts the cylindrical section 21. The opening of the second recess 12 is made by way of pressing and smaller than the first bead 30 so as to restrict the first bead 30 in the second recess 12. The first bead 30 is to be in contact with insides of a rectangular recess of a tool attached to the rod 10.

A resilient member 40 is located in the first recess 11 and biased between the inner end of the first recess 11 and the movable member 20. The resilient member 40 is a spring.

A connector 50 extends through the first hole 13 and the through hole 23, wherein the diameter of the connector 50 is the same as that of the through hole 23. The connector 50 is biased by the resilient member 40 to contact the periphery of the first hole 13. When the connector 50 moves within the first hole 13, the movable member 20 is moved within the first recess 11.

A sleeve 60 is mounted to the rod 10 and covers the first hole 13. The user can hold and pull the sleeve 60. The sleeve 60 has a first room 61 and a second room 62, wherein the first room 61 communicates one end of the sleeve 60 and the second room 62 is defined within the sleeve 60. The diameter of the second room 62 is larger than that of the first room 61 so as to form a shoulder 63 at the connection portion between the first and second rooms 61, 62. The connector 50 located within the second room 62 of the sleeve 60, and the two ends of the connector 50 contact the shoulder 63. The sleeve 60 covers the connector 50. The inner wall of the shoulder 63 is in flush with the first hole 13.

A fixing ring 70 is securely located in the second room 62 and has a flat face which contacts the connector 50 to restrict the connector 50 in the second room 62 and the first hole 13 so that the sleeve 60 and the fixing ring 70 are not disengaged from the rod 10. The outside of the fixing ring 70 is securely engaged with the inside of the second room 62.

An end piece 71 is connected to an opening of the first room 61. The end piece 71 contacts the cone-shaped section 22.

A rotary unit 80 is rotatably mounted to the rod 10, and has a tube 81, at least one second bead 82, at least one collar 83 and at least one clip 84. The tube 81 has a rough outer surface and is shorter than the rod 10. The tube 81 has a passage 811 defined axially therethrough, and the rod 10 extends through the passage 811 so that the tube 81 is rotatably mounted to the rod 10. At least one end of the tube 81 has a connection end 812 whose diameter is smaller than that of the tube 81. At least one bead hole 814 and a second groove 813 are defined in the outside of the connection end 812. The at least one bead hole 814 communicates with the passage 811 and is located corresponding to the at least one first groove 15. The second bead 82 is engaged with the at least one bead hole 814 and the at least one first groove 15. The at least one collar 83 is mounted to the connection end 812 and restricts the second bead 82 in the at least one bead hole 814 so that the second bead 82 movably contacts the rod 10. The at least one clip 84 is engaged with the second groove 813 to restrict the at least one collar 83 from being disengaged from the connection end 812 and from being movable axially along the connection end 812.

The clip 84 is a C-shaped clip. In this embodiment, the rod 10 has two first grooves 15, and the tube 81 is longer than the distance between the two first grooves 15. The tube 81 has two connection ends 812 respectively formed on two ends thereof. There are three second bead holes 814 located around each of the two connection ends 812, and each second bead hole 814 has one second bead 82 received therein. There are two collars 83 and two clips 84.

Figure 4:
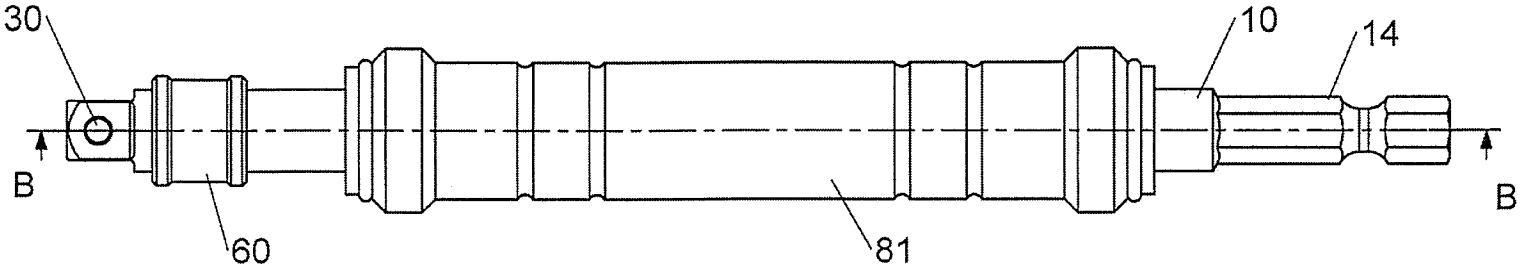
FIG. 4 is a side view of the tool positioning device of the present invention.
Figure 5:
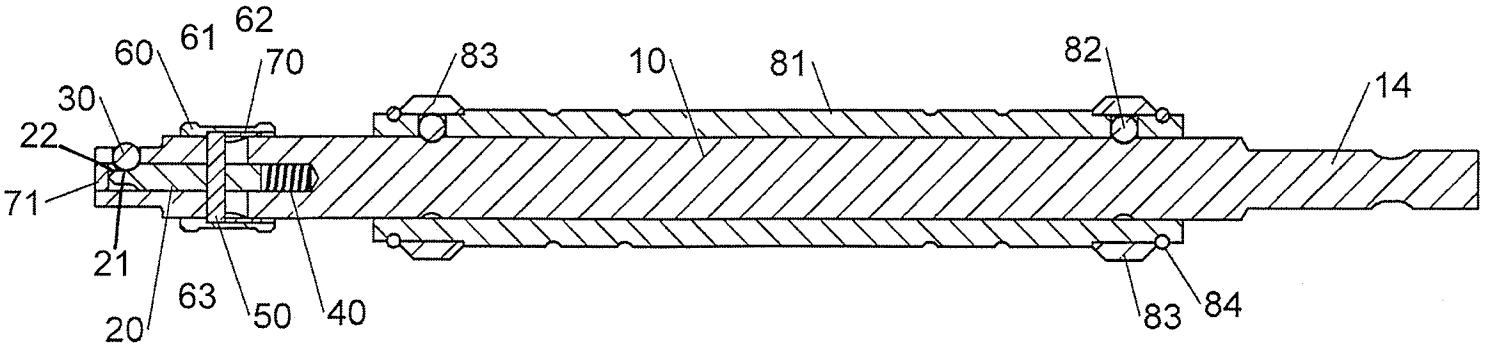
FIG. 5 is a cross sectional view, taken along line B-B in FIG. 4.

As shown in FIGS. 4 and 5, the movable member 20 is located in the first recess 11, and the first bead 30 contacts the cylindrical section 21. The resilient member 40 is located in the first recess 11 and biased between the inner end of the first recess 11 and the movable member 20. The connector 50 extends through the first hole 13 and the through hole 23. The sleeve 60 is mounted to the rod 10 and the shoulder 63 contacts the connector 50. The fixing ring 70 securely located in the second room 62 and contacts the connector 50 which is restricted by the sleeve 60 and the fixing ring 70. The connector 50 is movable back and forth in the first hole 13 to move the movable member 20 in the first room 61.

Figure 6:
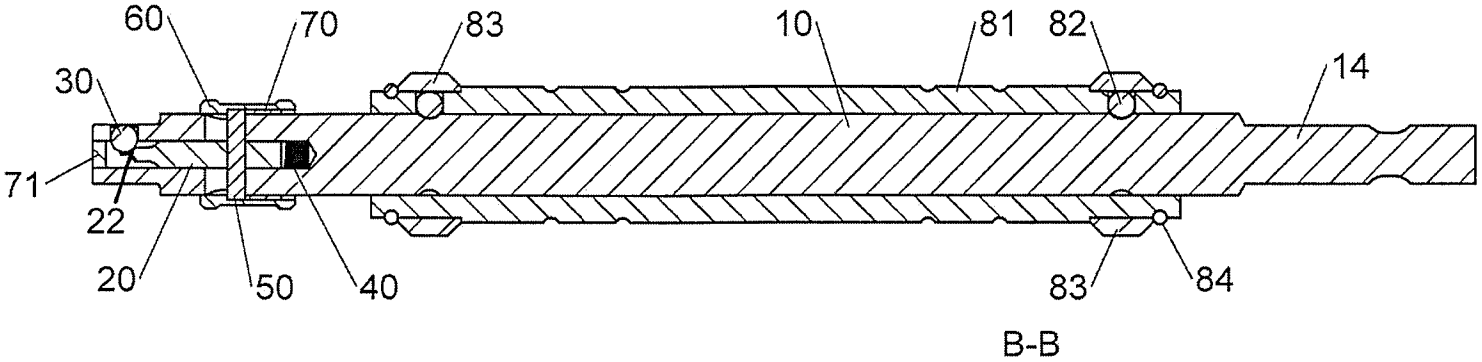
FIG. 6 is a cross sectional view to show that the sleeve is moved.

As shown in FIG. 6, when the user pulls the sleeve 60 backward, the connector 50 and the movable member are moved, and the resilient member 40 is compressed. The first bead 30 contacts the cone-shaped section 22, and retracted into the second room 62 so that the rod 10 is quickly separated from the tool attached with it.

Figure 7:
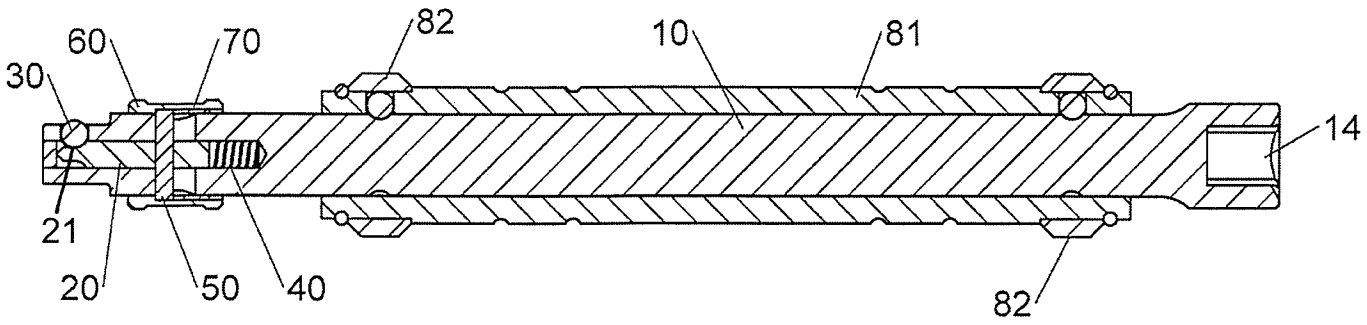
FIG. 7 is a cross sectional view to show the second embodiment of the tool positioning device of the present invention.

As shown in FIG. 7, in the second embodiment, the function end 14 is a rectangular recess so as to be connected with a rectangular head of a socket, an extension rod or a connector.

Figure 8:
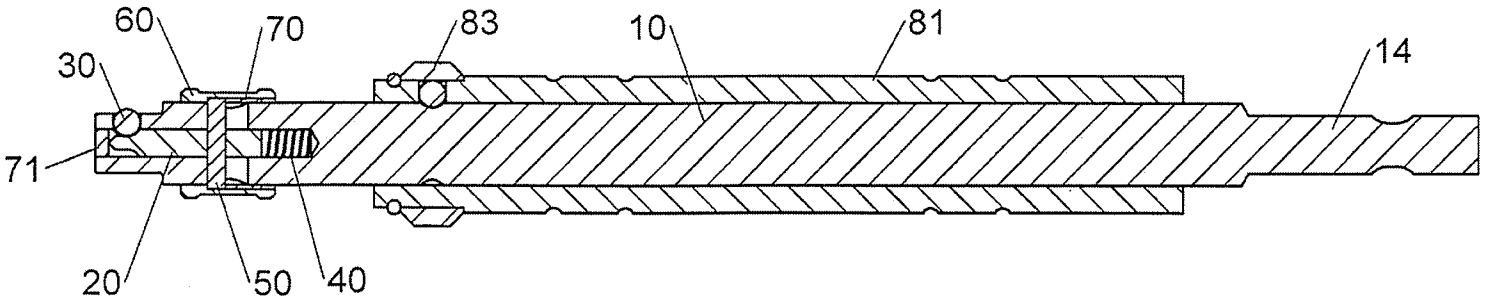
FIG. 8 is a cross sectional view to show the third embodiment of the tool positioning device of the present invention.

As shown in FIG. 8, in the third embodiment, the rod 10 has one first groove 15, the tube 81 has one connection end 812, and there are three second beads 82, there are one collar 83 and one clip 84.

Figure 9:
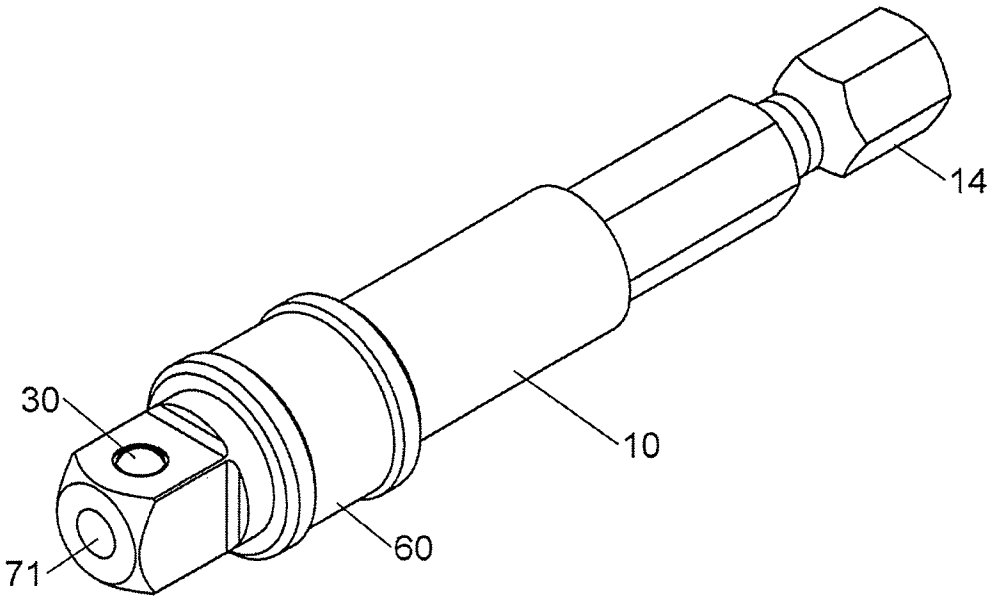
FIG. 9 is a perspective view to show the fourth embodiment of the tool positioning device of the present invention.
Figure 11:
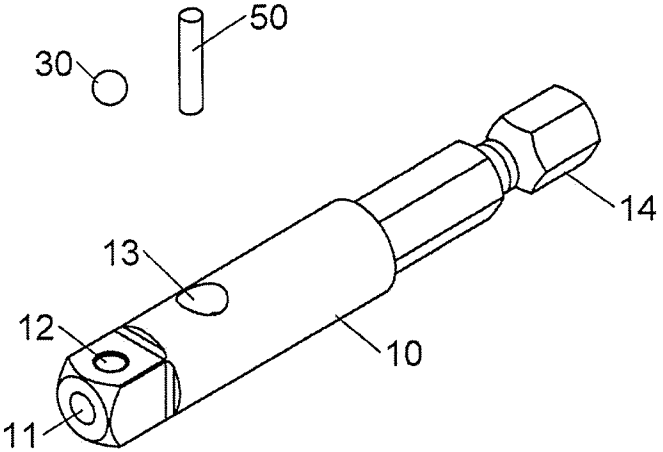
FIG. 11 is a side view to show the fifth embodiment of the tool positioning device of the present invention to show the first and second recesses.
Figure 11:
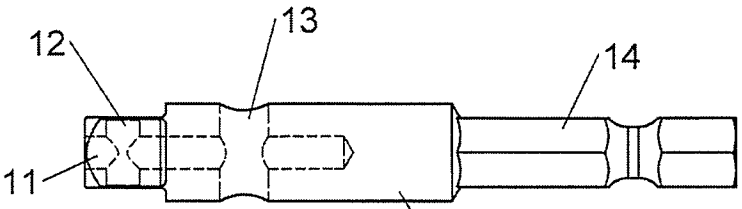
Figure 10:
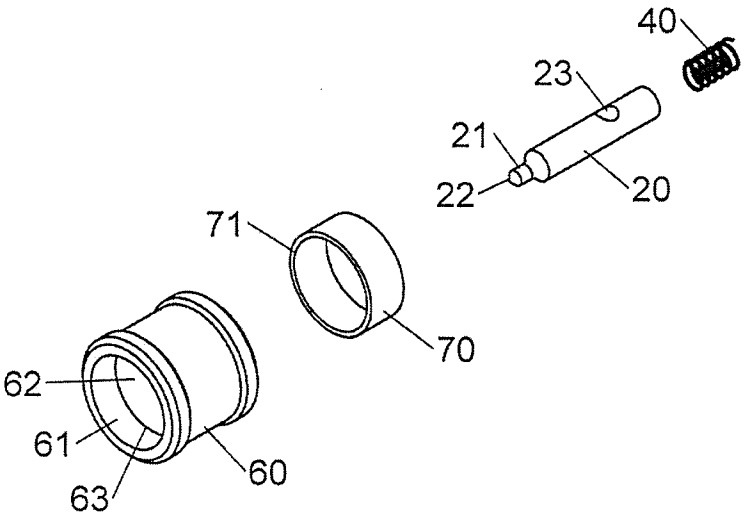
FIG. 10 is an exploded view to show the fifth embodiment of the tool positioning device of the present invention.
Figure 12:
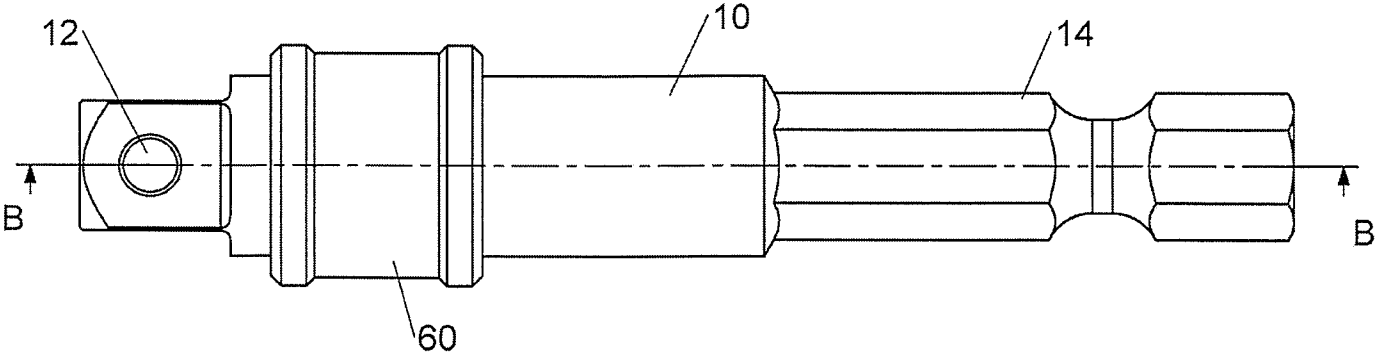
FIG. 12 is a side view to show the fifth embodiment of the tool positioning device of the present invention.
Figure 13:
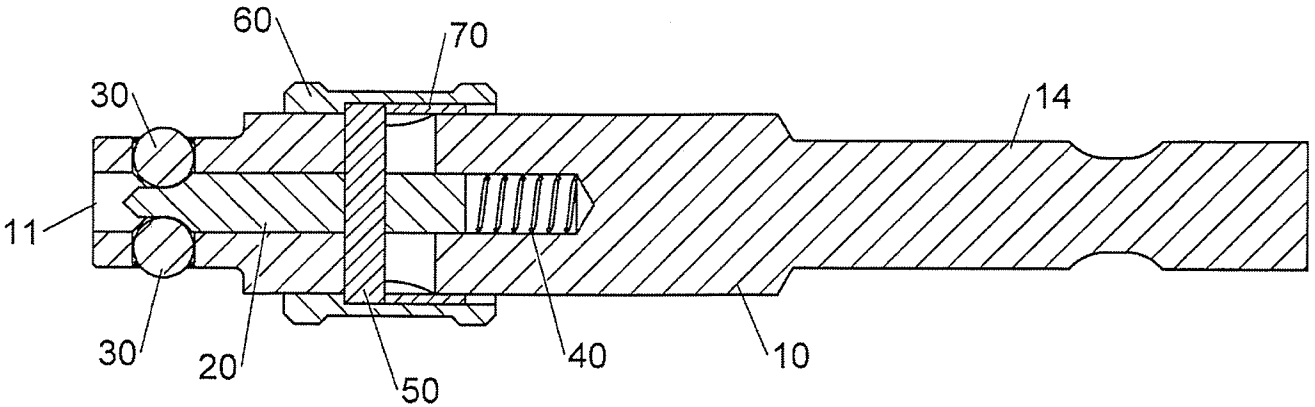
FIG. 13 is a cross sectional view, taken along line B-B in FIG. 12.

As shown in FIG. 9, in the fourth embodiment, the rod 10 has no rotary unit 80 mounted thereto.

As shown in FIGS. 10 to 13, in the fifth embodiment, the rod 10 has no rotary unit 80 mounted thereto. The second recess 12 is a through hole. There are two first beads 30 which are located in two open ends of the second room 62 and contact the cylindrical section 21. The two first beads 30 are located symmetrically to the movable member 20.

The advantages of the present invention are that when the user rotates the rod 10, the rotary unit 80 does not rotate with the rod 10 so that the user's hand does not scrub by the rotary unit 80. The sleeve 60 is rotatably mounted to the rod 10 and contacts the connector 50, so that when the user holds the sleeve 60 and rotates the rod 10, the sleeve 60 does not rotate with the rod 10 so that the user's hand does not scrub by the sleeve 60. The connector 50 is engaged with the sleeve 60, and is rotated with the sleeve 60 so that the connector 50. The friction between the connector 50 and the sleeve 60 is limited. The user can also hold the sleeve 60 and rotate the rod 10. The fixing ring 70 restricts the connector 50 in the second room 62 and the first hole 13. The second room 62 and the first hole 13 are both circular hole which is easily machined. The fixing ring 70 makes the connector 50 to be restricted in the second room 62, so that when the sleeve 60 is moved, the sleeve 60 and the fixing ring 70 move the connector 50 and the movable member 20. The second room 62 has two first beads 30 in the fifth embodiment so that when the tool is connected to the rod 10, the tool is always moved along the axis of the rod 10.

While we have shown and described the embodiment in accordance with the present invention, it should be clear to those skilled in the art that further embodiments may be made without departing from the scope of the present invention.

What is claimed is:

1. A tool positioning device comprising:

an elongate rod having a function end and a rectangular head respectively on two ends thereof, the rectangular head having a first recess and a second recess, the first recess defined axially in the rectangular head, the second recess being a circular recess and communicating with the first recess perpendicularly, a first hole defined through the rod and communicating with the first recess, a diameter of the first hole being larger than a diameter of the first recess and a diameter of the second recess, at least one first groove defined in an outside of the rod;

a movable member located in the first recess and having a cylindrical section extending from one end thereof, the cylindrical section having a cone-shaped section at a distal end thereof, the movable member having a through hole which is located to communicate with the first hole;

a first bead located in the second recess and contacting the cylindrical section, an opening of the second recess being smaller than the first bead so as to restrict the first bead in the second recess;

a resilient member located in the first recess and biased between an inner end of the first recess and the movable member;

a connector extending through the hole and the through hole, the connector being biased by the resilient member to contact a periphery of the first hole, when the connector moves within the first hole, the movable member is moved within the first recess;

a sleeve mounted to the rod and covering the first hole, the sleeve having a first room and a second room, the first room communicating one end of the sleeve and the second room defined within the sleeve, a diameter of the second room being larger than that of the first room so as to form a shoulder at a connection portion between the first and second rooms, the connector located within the second room of the sleeve, two ends of the connector contacting the shoulder;

a fixing ring securely located in the second room and contacting the connector to restrict the connector in the second room and the first hole so that the sleeve and the fixing ring are not disengaged from the rod, an outside of the fixing ring securely engaged with an inside of the second room;

an end piece connected to an opening of the first room, and a rotary unit having a tube, at least one second bead, at least one collar and at least one clip, the tube being shorter than the rod and having a passage defined axially therethrough, the rod extending through the passage so that the tube is rotatably mounted to the rod, at least one end of the tube having a connection end which has a diameter smaller than that of the tube, at least one bead hole and a second groove defined in an outside of the connection end, the at least one bead hole communicating with the passage and located corresponding to the at least one first groove, the second bead engaged with the at least one bead hole and the at least one first groove, the at least one collar mounted to the connection end and restricting the second bead in the at least one bead hole so that the second bead movably contacts the rod, the at least one clip engaged with the second groove to restrict the at least one collar from being disengaged from the connection end and from being movable axially along the connection end.

2. The tool positioning device as claimed in claim 1, wherein the rod has two first grooves, the tube is longer than a distance between the two first grooves, the tube has two connection ends respectively formed on two ends thereof, there are three second bead holes located around each of the two connection ends, each second bead hole has one second bead received therein, there are two collars and two clips.

3. The tool positioning device as claimed in claim 1, wherein the rod has one first groove, the tube has one connection end, there are three second beads, there are one collar and one clip.

4. The tool positioning device as claimed in claim 1, wherein the function end is a hexagonal end.

5. The tool positioning device as claimed in claim 1, wherein the function end is a rectangular recess.

6. The tool positioning device as claimed in claim 1, wherein the resilient member is a spring.

7. The tool positioning device as claimed in claim 1, wherein the tube has a rough outer surface.

8. The tool positioning device as claimed in claim 1, wherein a diameter of the through hole is smaller than ½ of a diameter of the first hole.

9. The tool positioning device as claimed in claim 1, wherein a diameter of the connector is the same as that of the through hole.

* * * * *